US006481875B1

(12) United States Patent
Bryant

(10) Patent No.: US 6,481,875 B1
(45) Date of Patent: Nov. 19, 2002

(54) LIGHT SOCKET COVER SYSTEM

(76) Inventor: Alan R. Bryant, 633 N. Taggart Ave., Clarksville, IN (US) 47129

( * ) Notice: Subject to any disclaimer, the term of this patent is extended or adjusted under 35 U.S.C. 154(b) by 158 days.

(21) Appl. No.: 09/658,971

(22) Filed: Sep. 11, 2000

(51) Int. Cl.[7] ..... F21V 17/06

(52) U.S. Cl. ..... 362/437; 362/377; 362/378; 362/294; 362/123; 439/135; 439/505; 439/901; 439/910; 439/188

(58) Field of Search ..... 362/377, 378, 362/437, 294, 123; 439/135, 505, 901, 910, 188

(56) References Cited

U.S. PATENT DOCUMENTS 3,849,640 A * 11/1974 McCarthy ..... 240/100
4,450,511 A * 5/1984 Micha ..... 362/267
5,281,158 A * 1/1994 Lin ..... 439/188
5,361,192 A * 11/1994 Lai ..... 362/123

* cited by examiner

*Primary Examiner*—Sandra O'Shea
*Assistant Examiner*—Guiyoung Lee
(74) *Attorney, Agent, or Firm*—Joseph N. Breaux

(57) ABSTRACT

A light socket cover system that is used by persons decorating with lights, including strings of lights, that provides an electrically nonconductive cover for providing a moisture tight covering for one or more empty light sockets and/or one or more light sockets with light bulbs installed therein. The light socket cover system includes a two-part sealable housing and in some options a socket filling structure to prevent access into the socket by fingers, water and the like.

2 Claims, 9 Drawing Sheets

FIG.2
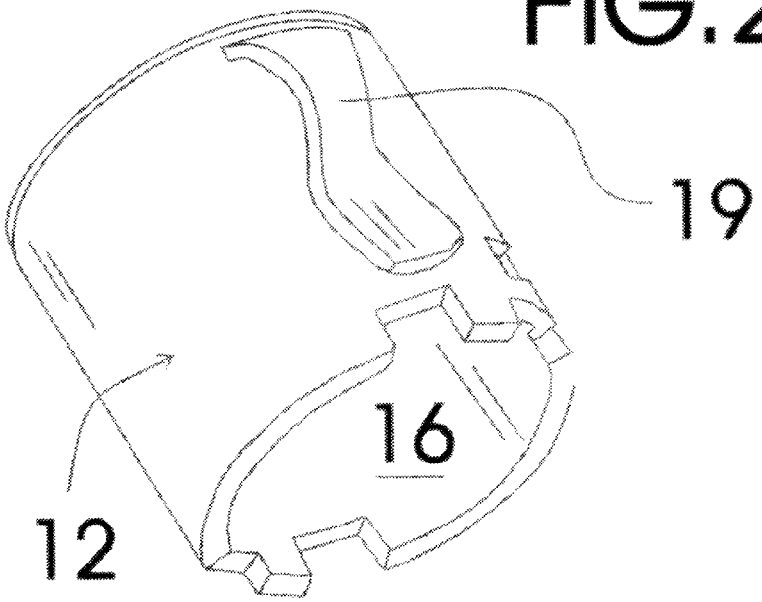
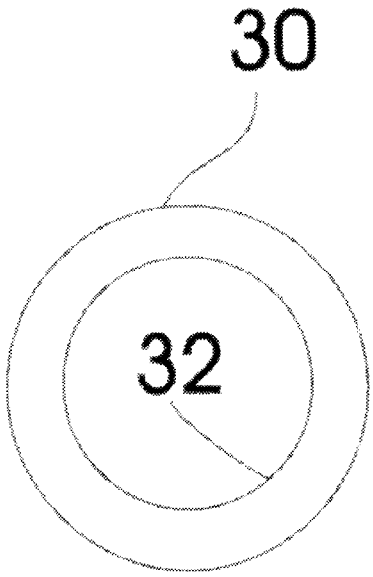
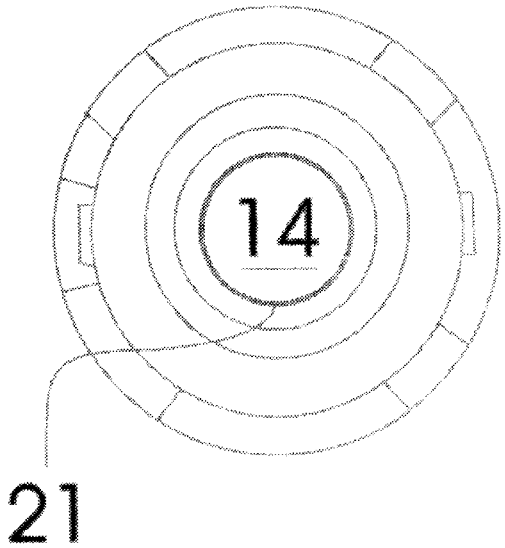
FIG.3
FIG.10

LIGHT SOCKET COVER SYSTEM

TECHNICAL FIELD

The present invention relates to lighting systems and more particularly to a light socket cover system that is used to safely cover the socket of a light bulb fixture assembly including multiple sockets so that decorative lighting effects can be achieved while safely covering unused sockets to protect the sockets as well as people and animals; the light socket cover system including a cover structure constructed from an electrically nonconductive, heat resistant material having a sealable cavity defined therein for receiving an empty socket in a sealing fashion to allow a user to achieve a desired lighting effect without risking electrical shock and/or fire caused by exposed empty light sockets; each of the cover structures having an external attachment mechanism such as a hook or clip provided thereon; each of the cover structure including a metal contact positioned within the sealable cavity thereof for seating into an empty socket.

BACKGROUND ART

Light strings are often used to provide decorative effects during holidays and other festive occasions. These light strings can often more lights than are needed or usable to achieve the desired lighting effect. When this is the case, it is necessary to disable one or more light bulbs of the string. The light bulb can be disabled by removing the light bulb. Removing the light bulb results in the problem of an exposed empty socket that can pose the risk of electrical shock to people and animals. It would be desirable, therefore, to have a light socket cover system that could be used by persons decorating with lights, including strings of lights, that provided an electrically nonconductive cover for providing a moisture tight covering for one or more empty light sockets.

GENERAL SUMMARY DISCUSSION OF INVENTION

It is thus an object of the invention to provide a light socket cover system that is used to safely cover the socket of a light bulb fixture assembly including multiple sockets so that decorative lighting effects can be achieved while safely covering unused sockets to protect the sockets as well as people and animals; the light socket cover system including a cover structure constructed from an electrically nonconductive, heat resistant material having a sealable cavity defined therein for receiving an empty socket in a sealing fashion to allow a user to achieve a desired lighting effect without risking electrical shock and/or fire caused by exposed empty light sockets; each of the cover structures having an external attachment mechanism such as a hook or clip provided thereon; each of the cover structure including a metal contact positioned within the sealable cavity thereof for seating into an empty socket.

Accordingly, a light socket cover system is provided. The light socket cover system includes multiple socket covers so that decorative lighting effects can be achieved while safely covering unused sockets to protect the sockets as well as people and animals; the light socket cover system including a cover structure constructed from an electrically nonconductive, heat resistant material having a sealable cavity defined therein for receiving an empty socket in a sealing fashion to allow a user to achieve a desired lighting effect without risking electrical shock and/or fire caused by exposed empty light sockets; each of the cover structures having an external attachment mechanism such as a hook or clip provided thereon; each of the cover structure including a metal contact positioned within the sealable cavity thereof for seating into an empty socket.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 2 is a perspective view of the top portion in isolation.

FIG. 3 is an underside plan view of the top portion in isolation showing an optional socket sealing plug assembly.

FIG. 10 is top plan view of a sealing O-ring positionable over the socket to assist in sealing the socket within the connected top and bottom portions.

FIG. 11 is a perspective view of a second embodiment of the top portion shown in FIG. 2 showing the side extension chamber formed therein for receiving the socket hook attached to the side of some light sockets to facilitate securing of the light socket in the desired position on a tree of the like.

EXEMPLARY MODE FOR CARRYING OUT THE INVENTION

Figure 1:
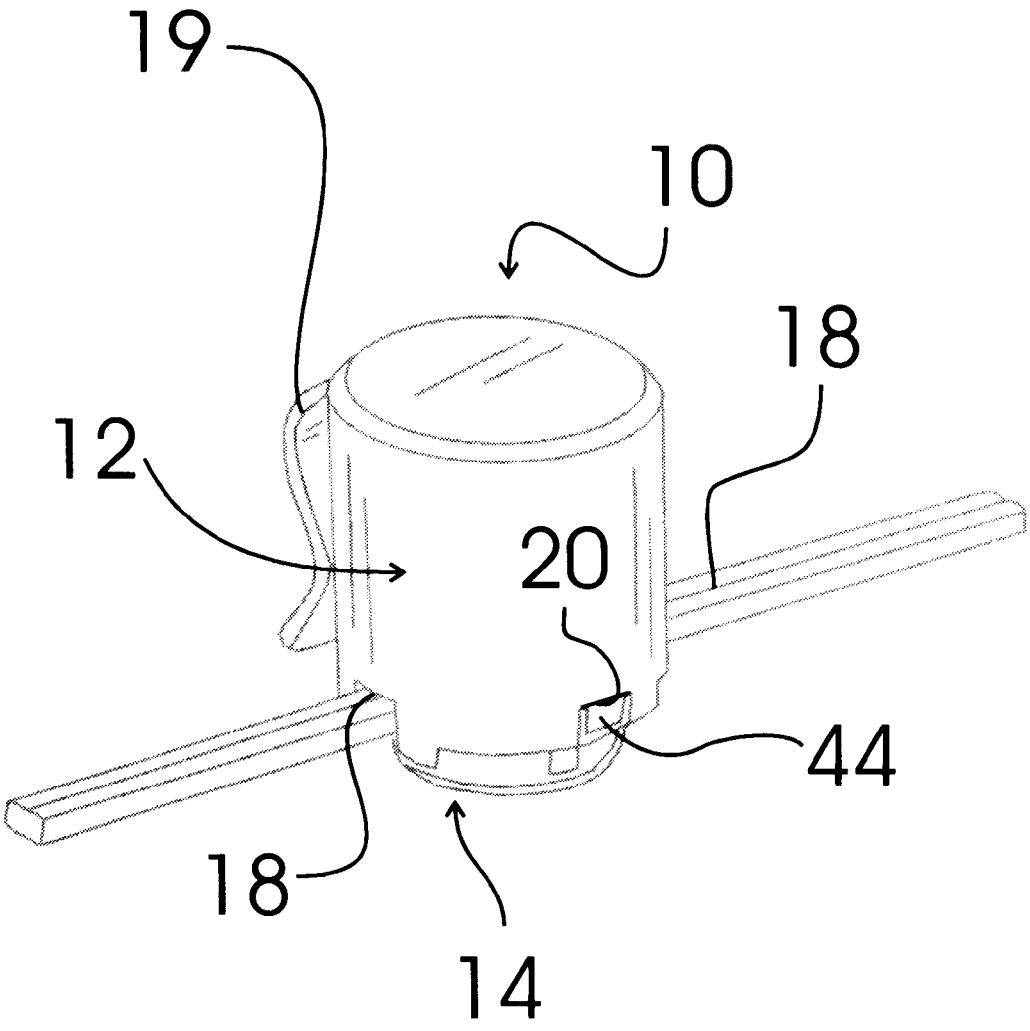
FIG. 1 is a partial cutaway plan view showing a first exemplary embodiment of the light socket cover system of the present invention showing the interlockable top and bottom portions in use covering an empty socket attached to and suspended from socket connecting wires of a representative light string.
Figure 4:
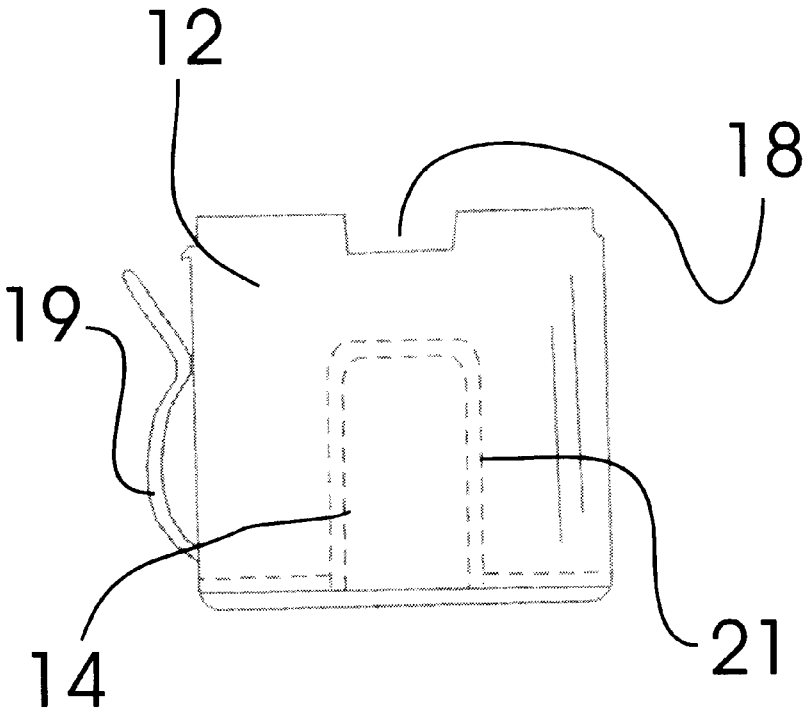
FIG. 4 is a side plan view of the top portion showing the optional socket sealing plug assembly in dashed lines and the cord passage cutouts along the bottom edge thereof.
Figure 5:
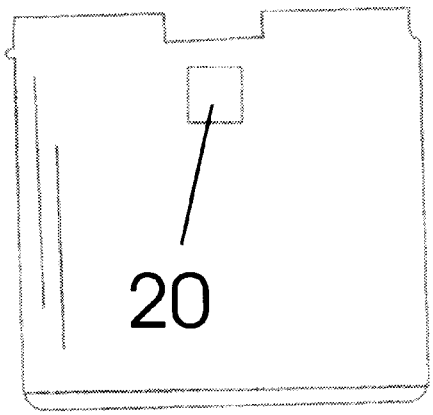
FIG. 5 is a side plan view of a second embodiment of the top portion showing one of the two bottom portion locking tab connecting apertures through the sidewall thereof without the optional socket sealing plug assembly.
Figure 6:
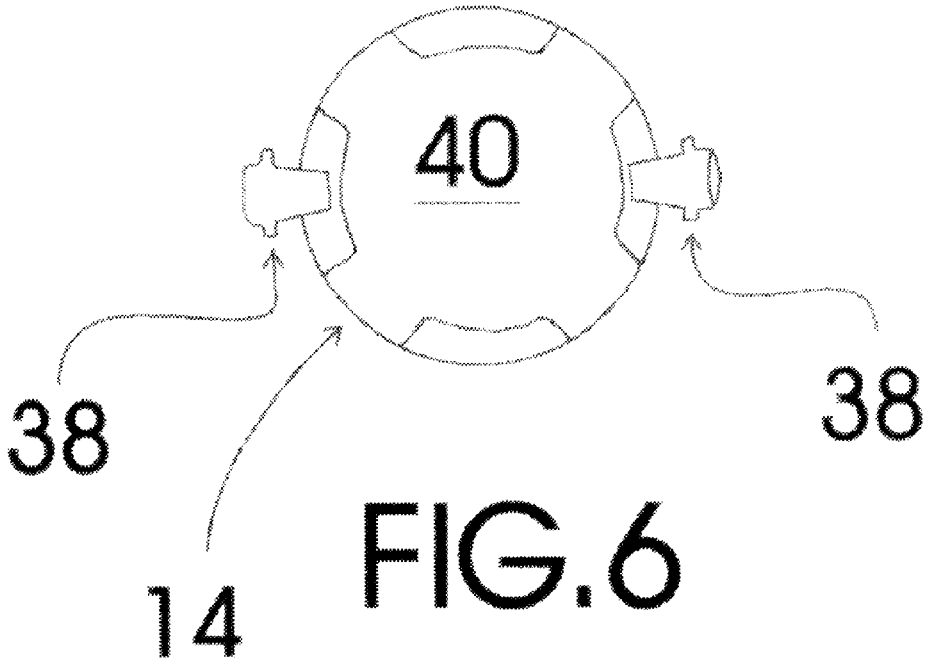
FIG. 6 is a top plan view of the bottom portion showing the two opposed locking tab assemblies extending upward from a bottom surface structure and opposed alignment structures extending upward from the bottom surface structure.
Figure 7:
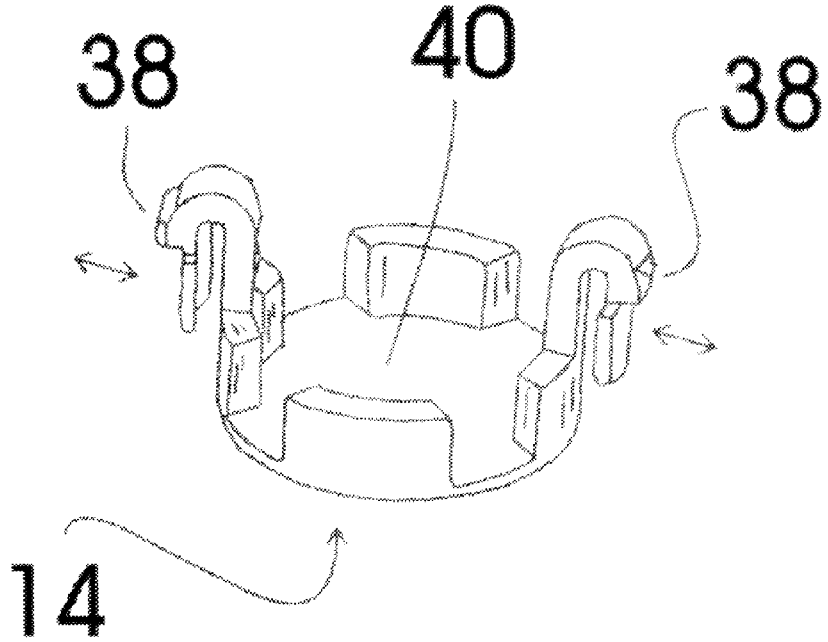
FIG. 7 is perspective view of the bottom portion showing the two opposed locking tab assemblies extending upward from a bottom surface structure and opposed alignment structures extending upward from the bottom surface structure.
Figure 8:
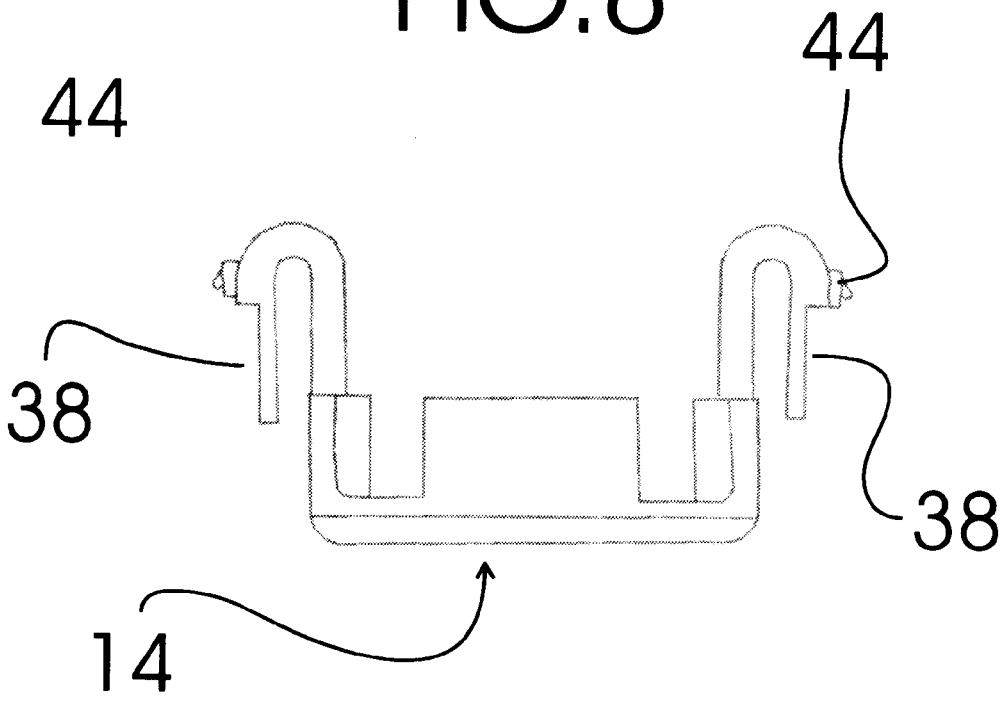
FIG. 8 is first side plan view of the bottom portion showing the two opposed locking tab assemblies extending upward from a bottom surface structure and opposed alignment structures extending upward from the bottom surface structure.
Figure 9:
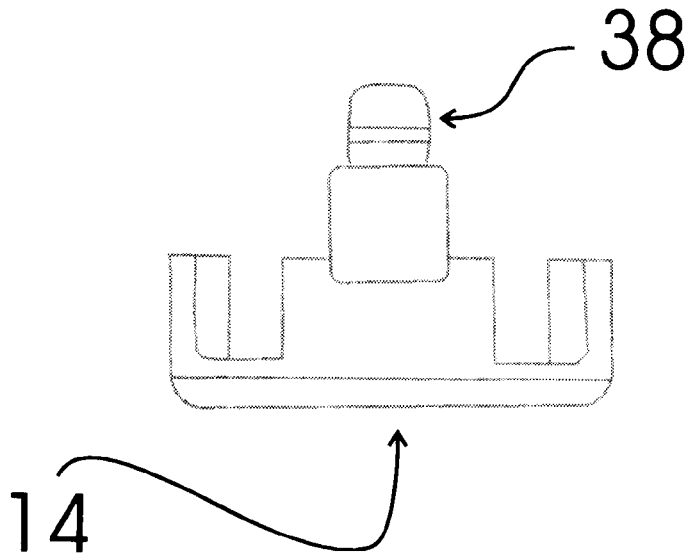
FIG. 9 is second side plan view of the bottom portion showing the two opposed locking tab assemblies extending upward from a bottom surface structure and opposed alignment structures extending upward from the bottom surface structure.

FIGS. 1–18 show various aspects of exemplary embodiments of the light socket cover system of the present invention.

FIGS. 1–10 show various aspects of an exemplary embodiment of the light socket cover system generally designated 10 that is molded from electrically nonconductive plastic. Light socket cover system 10 includes interlockable top and bottom portions, generally designated 12, 14, respectively, and a resilient sealing O-ring 17. Light socket cover system 10 is adapted for covering and sealing a light socket attached and suspended from socket connecting wires 18 such as those commonly used for decorating during the Christmas holidays.

Top portion 12 is molded to form a socket receiving cavity 16 that in this embodiment has an optional, detachable, socket sealing plug assembly 14 provided therein for seating into an empty light socket. Socket sealing plug is provided with an electrical contact 21 for maintaining electrical continuity along a light string. Socket sealing plug 14 can be detached when not needed. Top portion 12 also includes a pair of opposed string passage slots 23, an external clip member 19, a pair of locking tab connecting apertures 20, and a metal contact member 21 for seating into empty light sockets to provide continuity along the light string. Resilient O-ring 17 is selected such that the exterior 30 forms a seal with the interior wall of socket receiving cavity 16 and an interior diameter 32 selected to form a seal around the light socket.

Bottom portion 14 includes two opposed locking tab assemblies 38 that extending upward from a bottom surface structure 40. Each locking tab structure is deflectable to allow for insertion of the locking tab structure into socket receiving cavity and includes a locking tab 44 that seat within a locking tab connecting aperture 20.

Figure 11:
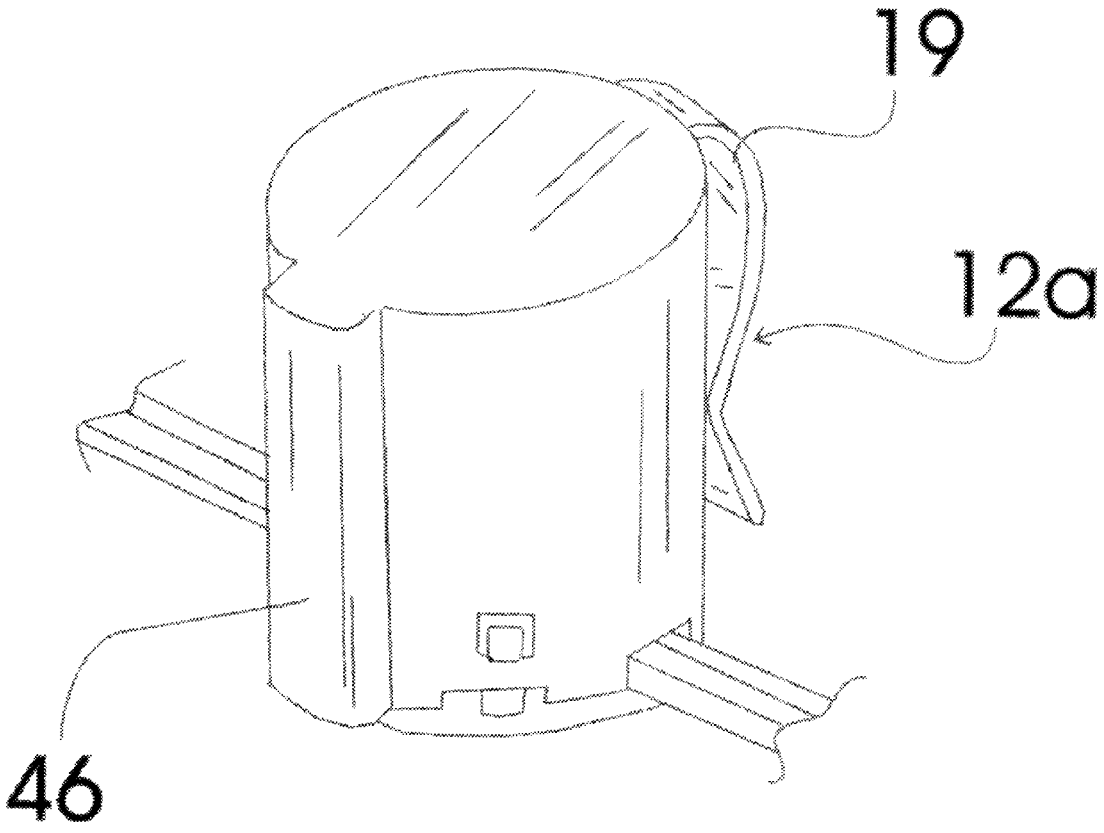
Figure 12:
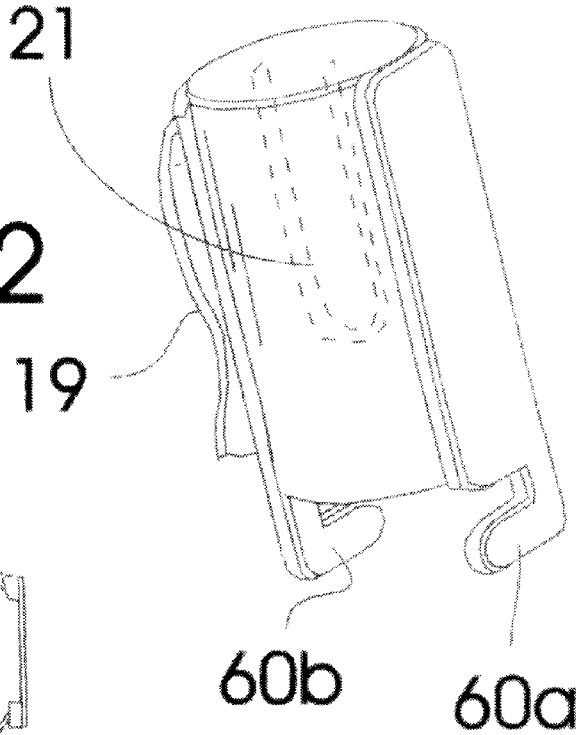
FIG. 12 is a perspective view of a second embodiment of the top portion of a second embodiment of the light socket cover system of the present invention showing the top cover portion and the two securing hooks.
Figure 15:
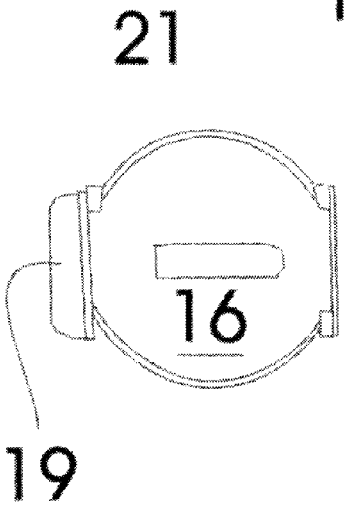
FIG. 15 is a perspective view of the O-ring forming the remainder of the second embodiment of the light socket cover system that is externally sized to friction fit against the interior walls of the top portion and in inner diameter to form a seal round the base of the light socket prior to its insertion into the socket receiving cavity.
Figure 14:
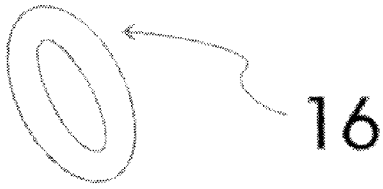
FIG. 14 is a side plan view of the O-ring forming the remainder of the second embodiment of the light socket cover system.
Figure 13:
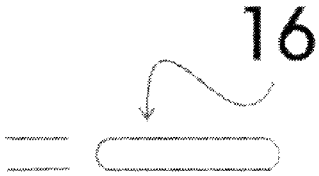
FIG. 13 is an underside view of the top portion of the second embodiment of the light socket cover system shown in FIG. 12 showing the socket receiving cavity.
Figure 16:
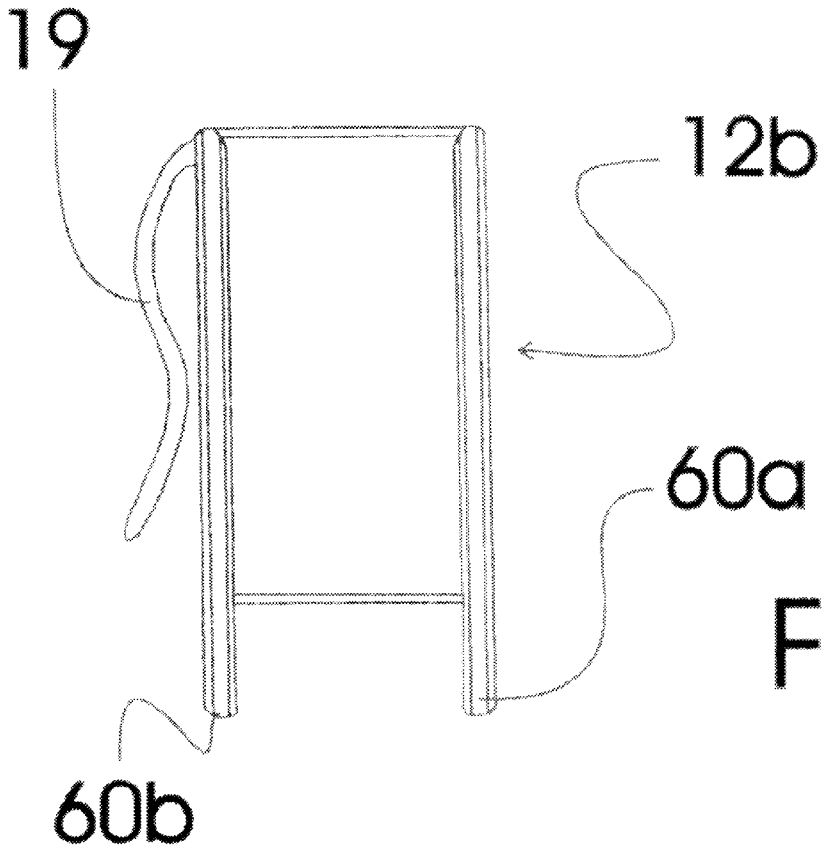
FIG. 16 is a side view of the top portion of the second embodiment of the light socket cover system shown in FIG. 12.
Figure 17:
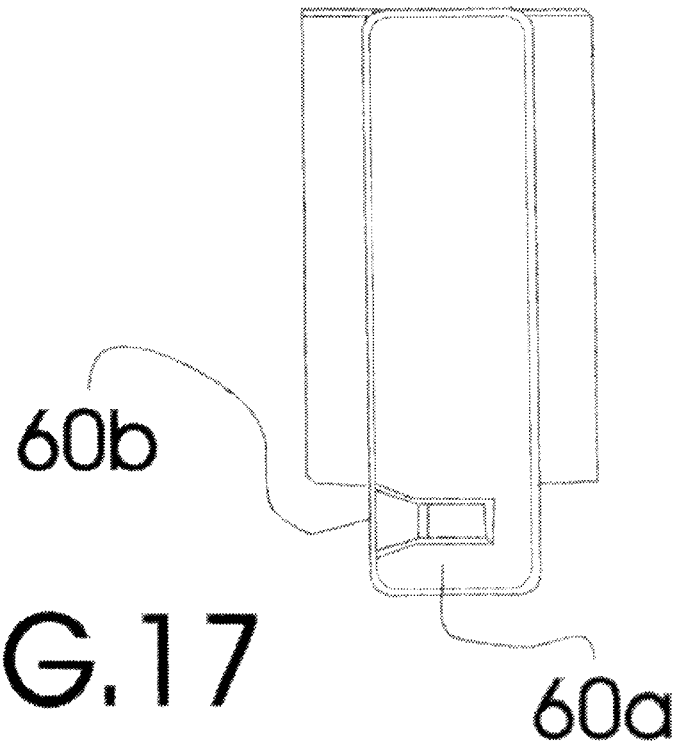
FIG. 17 is a second side view of the top portion of the second embodiment of the light socket cover system shown in FIG. 12.
Figure 18:
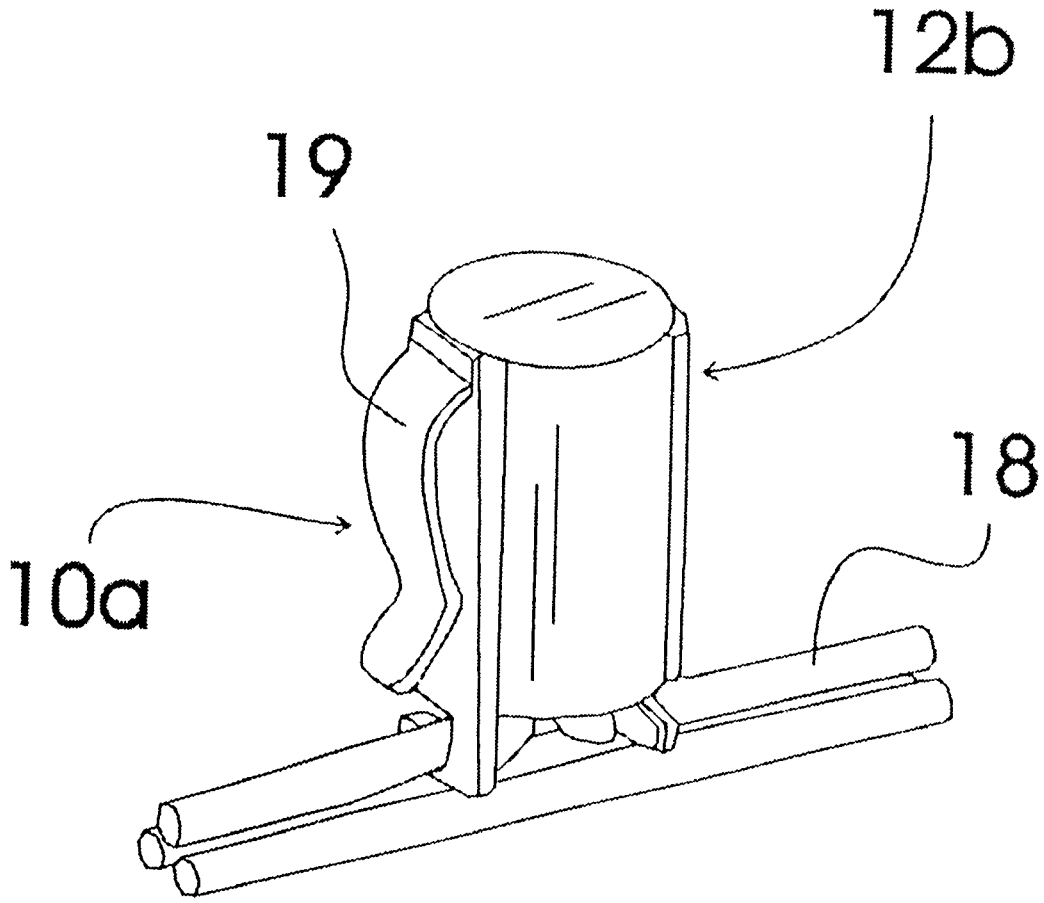
FIG. 18 is a perspective view of the second embodiment of the light socket cover system shown in FIG. 12 secured over a light socket on a representative section of a light string.

FIG. 11 show a second exemplary embodiment of top portion designated 12*a* that further include a side extension chamber 46 formed therein for receiving a socket hook attached to the side of some light sockets to facilitate securing of the light socket in the desired position on a tree of the like.

FIGS. 12–18 show a second exemplary embodiment of the light socket cover system of the present invention, generally designated 10*a*. In this embodiment cover system 10*a* includes a top cover portion 12*b* and a resilient O-ring 17. Top cover portion 12*b* has a socket receiving cavity 16 for receiving a socket and further includes a pair of oppositely oriented light wire connecting hooks 60*a*, 60*b*, each having a string passage slot 18 formed therein, that are rotated into connection with the socket connecting wires 18 once the socket is inserted into cavity 16. O-ring 17 is used in the same manner as the O-ring in the previous embodiment.

It can be seen from the preceding description that a light socket cover system has been provided.

It is noted that the embodiment of the light socket cover system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A light socket cover system for the covering of one of a number of light bulb sockets attached to and suspended from socket connecting wires to form a light string; the light socket cover system comprising:

a cover structure constructed from an electrically nonconductive, heat resistant material having a sealable cavity defined therein for receiving an empty light bulb socket in a sealing fashion to allow a user to achieve a desired lighting effect while minimizing risks posed by an electrically connected, exposed empty light bulb socket;

the cover structure including a top cover portion and a bottom cover portion;

top cover portion defining a sealable socket receiving cavity sized and shaped to receive one of a number of empty light bulb sockets attached to and suspended from socket connecting wires to form a light string and having a socket insert portion connectable thereto within the socket receiving cavity such that the insert portion is insertable into an empty light bulb socket while the bottom cover portion is snap fit into sealing connection with the top cover portion using two opposed locking tab assemblies that each include a deflectable locking tab extending from the bottom cover portion and a corresponding locking tab connecting aperture formed into the top cover portion in a manner to seal the sealable socket receiving cavity; a wire passage opening being provided through a side of the bottom cover portion to allow socket connecting wires in connection with an empty light bulb socket sealed within the socket receiving cavity to pass therethrough;

the cover structure having an external attachment mechanism provided thereon;

the cover structure including a metal contact positioned on the socket insert portion within the sealable socket receiving cavity of the top cover portion thereof in a manner such that the metal contact seats into the empty light bulb socket such that electrical continuity is maintained along a string lights of which the empty light bulb socket is a part.

2. A light socket cover system for the covering of an empty light bulb socket that is attached to and suspended from socket connecting wires in a manner to form a light string; the light socket cover system comprising:

a top cover portion having an interior wall defining an empty light bulb socket receiving cavity therein; and a resilient O-ring having an O-ring opening having a diameter selected to sealing engage socket sidewalls of an empty light bulb socket inserted through the O-ring opening and an O-ring exterior surface adapted to sealingly contact the interior wall of the top cover portion when an empty light bulb socket is inserted through the O-ring opening and the O-ring and the empty light bulb socket are inserted into the empty light bulb socket receiving cavity;

said top cover portion having a socket receiving cavity that is sized and shaped for receiving an empty light bulb socket and that further includes a pair of oppositely oriented light wire connecting hooks that extend down from a perimeter edge of the top cover portion defining an opening into the socket receiving cavity; each light wire connecting hook defining a wire string passage slot open on a side thereof such that the pair of oppositely oriented wire connecting hooks are rotatable into connection with the socket connecting wires once an empty light bulb socket is inserted into sealing connection with the O-ring opening of the O-ring and the empty light bulb socket and O-ring are sealingly inserted into the socket receiving cavity;

the cover portion having an external attachment mechanism provided thereon;

the cover portion including a metal contact member positioned within the empty light bulb socket receiving cavity and oriented such that the metal contact member seats into an empty light bulb socket sealed within the empty light bulb socket receiving cavity such that electrical continuity is maintained along a string of lights of which the empty light bulb socket sealed within the empty light bulb socket receiving cavity is a part.

* * * * *